US009630064B1

(12) United States Patent
Cardello, Sr. et al.

(10) Patent No.: US 9,630,064 B1
(45) Date of Patent: Apr. 25, 2017

(54) BALL RETRIEVING ASSEMBLY

(71) Applicants: Gerard Cardello, Sr., Pittsburgh, PA (US); Carol Cardello, Pittsburgh, PA (US)

(72) Inventors: Gerard Cardello, Sr., Pittsburgh, PA (US); Carol Cardello, Pittsburgh, PA (US)

( * ) Notice: Subject to any disclaimer, the term of this patent is extended or adjusted under 35 U.S.C. 154(b) by 0 days.

(21) Appl. No.: 15/052,847

(22) Filed: Feb. 24, 2016

(51) Int. Cl.
*A63B 47/02* (2006.01)

(52) U.S. Cl.
CPC ..... *A63B 47/02* (2013.01)

(58) Field of Classification Search
CPC ..... A63B 47/02; B65D 85/00
USPC ..... 294/19.2; 206/315.9; 473/286, 460; D9/414, 503
See application file for complete search history.

(56) References Cited

U.S. PATENT DOCUMENTS 2,760,807 A * 8/1956 Watson ..... A63B 47/02 294/19.2
2,962,187 A * 11/1960 Morris ..... A01K 97/08 206/315.11
3,412,897 A * 11/1968 Slater ..... A63B 47/00 221/226
3,558,170 A * 1/1971 Stanworth ..... A63B 47/02 294/19.2
4,058,336 A 11/1977 Parkinson
4,088,251 A * 5/1978 Rodriguez ..... A63B 47/001 206/315.9
4,101,029 A * 7/1978 Feinberg ..... A63B 39/025 206/315.9
4,629,235 A * 12/1986 Logue ..... A63B 47/02 221/306
5,040,675 A * 8/1991 Cleveland ..... A63B 47/00 206/315.9
5,060,996 A * 10/1991 Garnes ..... A63B 47/02 221/309
5,188,410 A * 2/1993 Summers ..... A63B 47/02 294/19.2
5,292,161 A * 3/1994 Green ..... A63B 47/02 206/315.9
5,433,491 A 7/1995 Green
5,466,027 A 11/1995 Hockey
5,511,666 A * 4/1996 Grip ..... B65D 85/00 206/315.9
5,775,751 A 7/1998 Nelson
5,848,690 A * 12/1998 Granger ..... B65D 81/2053 206/315.9
D411,278 S 6/1999 Sammons et al.
6,021,896 A * 2/2000 Marshall ..... B65D 21/0205 206/315.9

(Continued)

*Primary Examiner* — Paul T Chin

(57) ABSTRACT

A ball retrieving assembly includes a tube that has a first end, a second end and a perimeter wall extending between the first and second ends. Each of the first and second ends is open. The tube has a cylindrical shape. The tube has a diameter that is greater than a diameter of a ball to be received by the tube. A ring is attached to an inner surface of the perimeter wall adjacent to the first end. The ring is comprised of a resiliently compressible material. The ring has a diameter that is less than the ball. The ring is compressible to allow the ball to pass through the ring and into the tube. The ring retains the ball in the tube. A cover is removably positioned over the second end. The ball is removable through the second end when the cover is removed.

7 Claims, 3 Drawing Sheets

(56) References Cited

U.S. PATENT DOCUMENTS

| | | | | |
|---|---|---|---|---|
| D580,999 | S | 11/2008 | Mitchell | |
| 8,201,864 | B2 * | 6/2012 | Wright | A63B 47/02 294/19.2 |
| 2004/0029656 | A1 * | 2/2004 | Vannoy | A63B 65/122 473/505 |
| 2005/0052040 | A1 | 3/2005 | Hellerson | |
| 2011/0000800 | A1 * | 1/2011 | Rohr | B65D 51/2828 206/219 |
| 2014/0306471 | A1 | 10/2014 | Vital, Jr. | |

* cited by examiner

BALL RETRIEVING ASSEMBLY

BACKGROUND OF THE DISCLOSURE

Field of the Disclosure

The disclosure relates to ball engaging and storing devices and more particularly pertains to a new ball engaging and storing device for retrieving balls from a ground surface.

SUMMARY OF THE DISCLOSURE

An embodiment of the disclosure meets the needs presented above by generally comprising a tube has a first end, a second end and a perimeter wall extending between the first and second ends. Each of the first and second ends is open. The tube has a cylindrical shape. The tube has a diameter that is greater than a diameter of a ball to be received by the tube. A ring is attached to an inner surface of the perimeter wall adjacent to the first end. The ring is comprised of a resiliently compressible material. The ring has a diameter that is less than the ball. The ring is compressible to allow the ball to pass through the ring and into the tube. The ring retains the ball in the tube. A cover is removably positioned over the second end. The ball is removable through the second end when the cover is removed.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
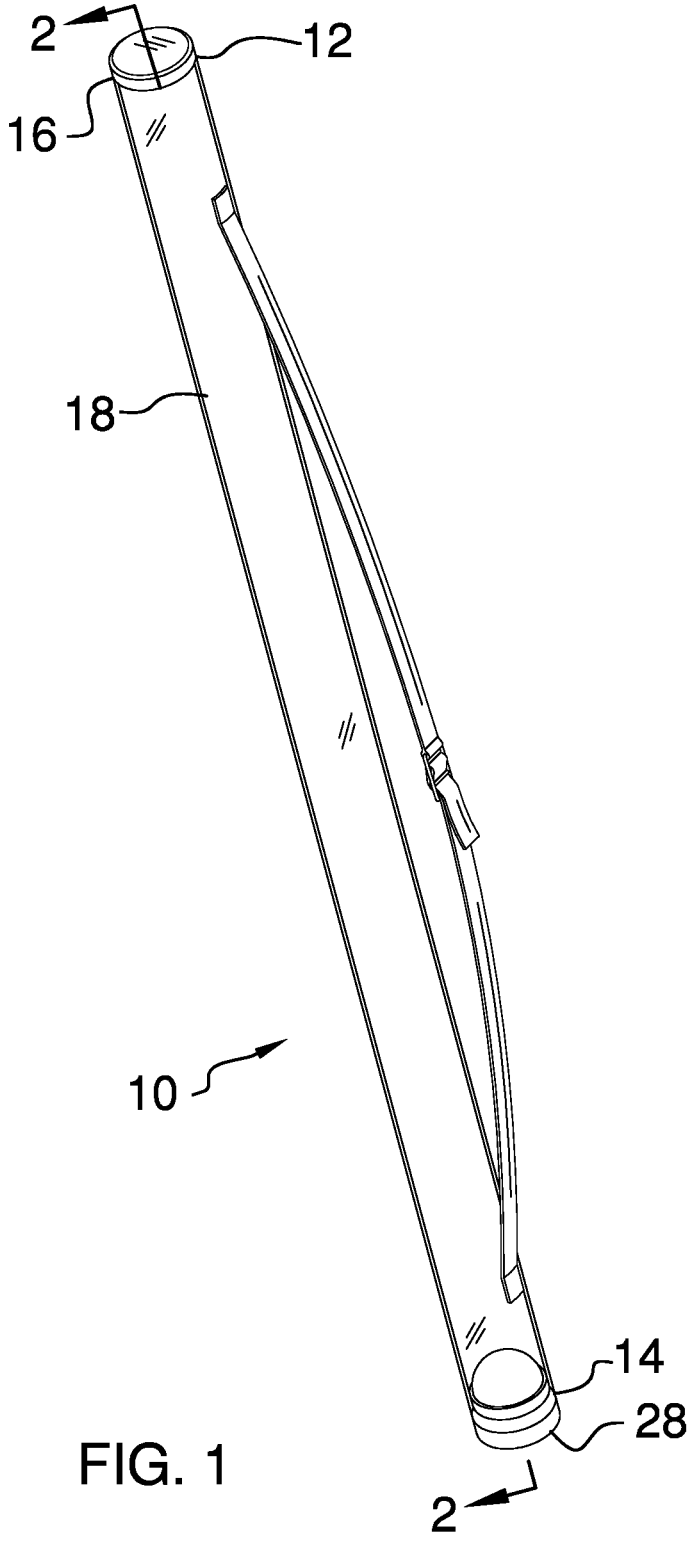
FIG. 1 is a side perspective view of a ball retrieving assembly according to an embodiment of the disclosure.
Figure 2:
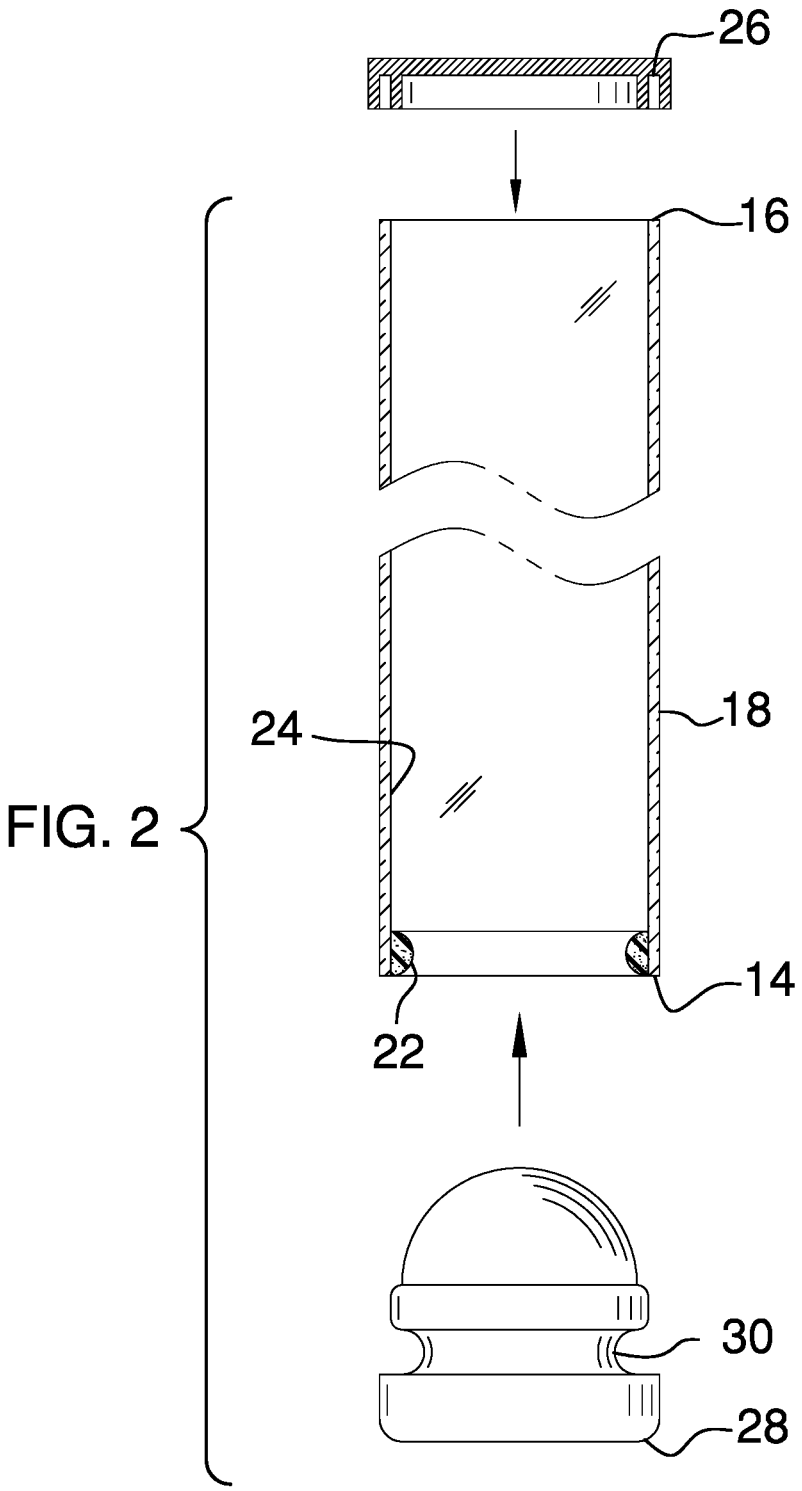
FIG. 2 is a broken cross-sectional view of an embodiment of the disclosure taken along line 2-2 of FIG. 1.
Figure 3:
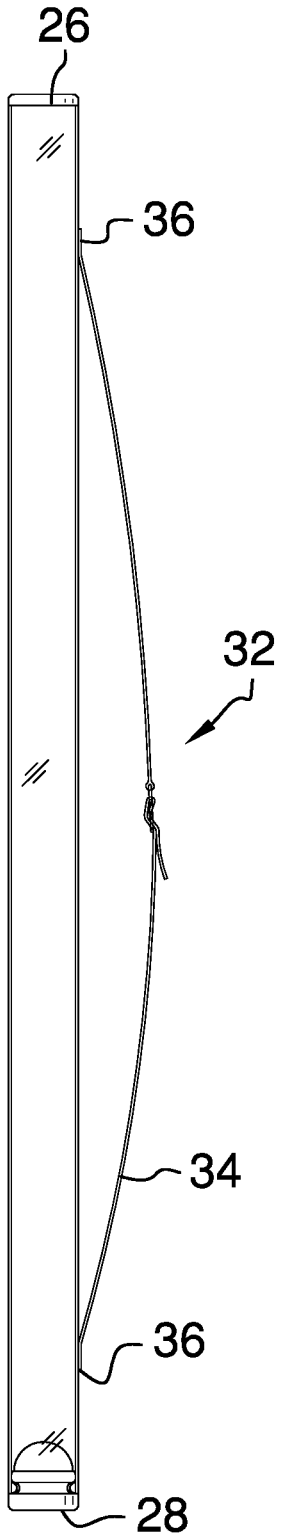
FIG. 3 is a side view of an embodiment of the disclosure.
Figure 4:
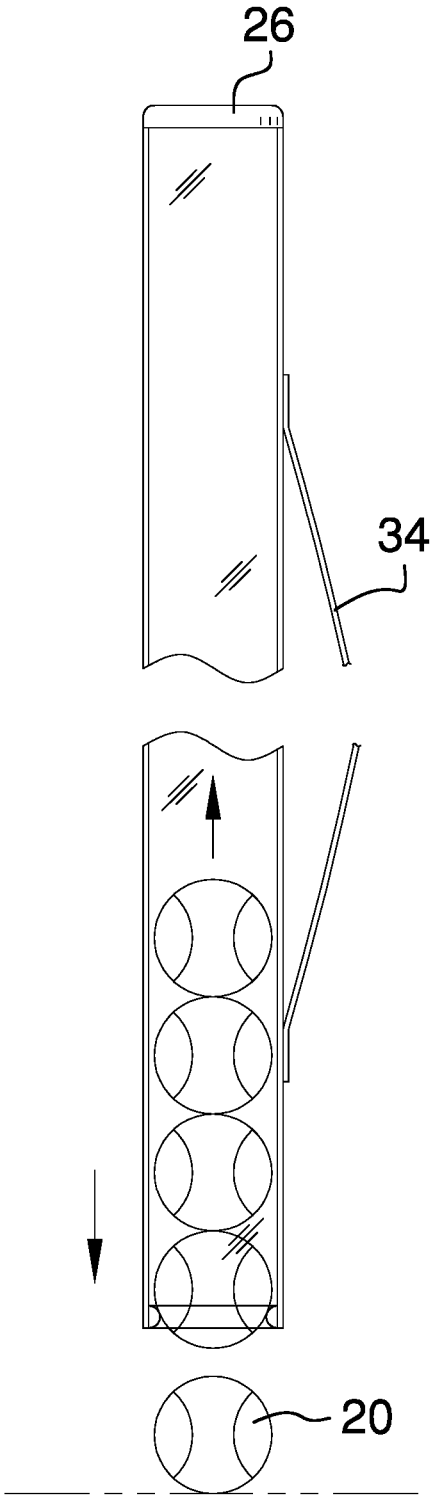
FIG. 4 is a broken side in-use view of an embodiment of the disclosure.

With reference now to the drawings, and in particular to FIGS. 1 through 4 thereof, a new ball engaging and storing device embodying the principles and concepts of an embodiment of the disclosure and generally designated by the reference numeral 10 will be described.

As best illustrated in FIGS. 1 through 4, the ball retrieving assembly 10 generally comprises a tube 12 that has a first end 14, a second end 16 and a perimeter wall 18 extending between the first 14 and second 16 ends. Each of the first 14 and second 16 ends is open. The tube 12 has a length from the first end 14 to the second end 16 that is between 2.5 feet and 4.0 feet and has a cylindrical shape. The tube 12 has a diameter that is greater than a diameter of a ball 20 to be received by the tube 12. The diameter of the tube 12 will depend on the size of the ball 20. Generally, the assembly 10 will be used with tennis balls and therefore the diameter will be greater than 2.7 inches and less than 3.5 inches. If the assembly 10 is used for other balls, such as baseballs, the diameter will typically be greater than 2.9 inches. The perimeter wall 18 may be comprised of a transparent material to see balls 20 positioned therein. A handle 32 is attached to the tube 12 and may comprise a strap 34 having a pair of opposed ends 36 each attached to the tube 12. The strap 34 may further have an adjustable length.

A ring 22 is attached to an inner surface 24 of the perimeter wall 18 adjacent to the first end 14. The ring 22 is comprised of a resiliently compressible material such as an elastomeric material. The ring 22 has an inner diameter that is less than the diameter of the ball 20, and generally the inner diameter of the ring 22 will be less than 2.6 inches. The ring 22 is compressible to allow the ball 20 to pass through the ring 22 and into the tube 12. The ring 22 retains the ball 20 in the tube 12 once the ball 20 passes the ring 22.

A cover 26 is removably positioned over the second end 16. The ball 20 is removable through the second end 16 when the cover 26 is removed. The cover 26 may be a friction fit type cover, threadably coupled to the tube 12 or other conventional structures. A cap 28 is removably extended into the first end 14 to close the first end 14. The cap 28 may have an annular groove 30 therein for receiving the ring 22.

In use, when a user of the assembly wishes to collect a plurality of balls, such as tennis balls on a tennis court, the user presses the first end against the ball as it is on the ground so that the ball is pressed through the ring. Once the ball passes the ring, it will be retained within the tube. The user then moves to the next ball and repeats this process until all of the balls have been retrieved. The balls may be removed through the second end when needed. The tube may used to store the balls when not being used for collecting the balls.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A ball retrieval and holding system, said system including:

a tube having a first end, a second end and a perimeter wall extending between said first and second ends, each of said first and second ends being open, said tube having a cylindrical shape, said tube having a diameter being greater than a diameter of a ball to be received by said tube;

a ring being attached to an inner surface of said perimeter wall adjacent to said first end, said ring being comprised of a resiliently compressible material, said ring having a diameter being less than the ball, wherein said ring is compressible to allow the ball to pass through said ring and into said tube, said ring retaining the ball in said tube; and a cover being removably positioned over said second end, said ball being removable through said second end when said cover is removed; and a cap being removably extended into said first end to close said first end, said cap having a convex upper surface wherein said upper surface defines a dome shape corresponding to a shape of the ball received into said tube through said first end wherein insertion of said cap into said first end simulates insertion of the ball through said ring.

2. The ball retrieval and holding system according to claim 1, wherein said tube has a length from said first end to said second end being between 2.5 feet and 4.0 feet.

3. The ball retrieval and holding system according to claim 1, wherein said perimeter wall is comprised of a transparent material.

4. The ball retrieval and holding system according to claim 1, wherein said cap has an annular groove therein for receiving said ring.

5. The ball retrieval and holding system according to claim 1, further including a handle being attached to said tube.

6. The ball retrieval and holding system according to claim 5, wherein said handle comprises a strap having a pair of opposed ends attached to said tube, said strap having an adjustable length.

7. A ball retrieval and holding system, said system including:

a tube having a first end, a second end and a perimeter wall extending between said first and second ends, each of said first and second ends being open, said tube having a length from said first end to said second end being between 2.5 feet and 4.0 feet and having a cylindrical shape, said tube having a diameter being greater than a diameter of a ball to be received by said tube, said perimeter wall being comprised of a transparent material;

a ring being attached to an inner surface of said perimeter wall adjacent to said first end, said ring being comprised of a resiliently compressible material, said ring having a diameter being less than the ball, wherein said ring is compressible to allow the ball to pass through said ring and into said tube, said ring retaining the ball in said tube;

a cover being removably positioned over said second end, said ball being removable through said second end when said cover is removed;

a cap being removably extended into said first end to close said first end, said cap having a convex upper surface wherein said upper surface defines a dome shape corresponding to a shape of the ball received into said tube through said first end wherein insertion of said cap into said first end simulates insertion of the ball through said ring, said cap having an annular groove therein for receiving said ring; and a handle being attached to said tube, said handle comprising a strap having a pair of opposed ends attached to said tube, said strap having an adjustable length.

* * * * *